United States Patent [19]

Kuehnle

[11] 4,258,113

[45] * Mar. 24, 1981

[54] ENDLESS BELT OR CYLINDER FOR USE WITH ELECTROSTATIC IMAGING AND METHOD OF MAKING THE SAME

[75] Inventor: Manfred R. Kuehnle, Lexington, Mass.

[73] Assignee: Coulter Systems Corporation, Bedford, Mass.

[ * ] Notice: The portion of the term of this patent subsequent to May 24, 1994, has been disclaimed.

[21] Appl. No.: 864,376

[22] Filed: Dec. 27, 1977

[51] Int. Cl.[3] ..... G03G 5/04; C23C 15/00

[52] U.S. Cl. ..... 430/94; 430/135; 204/192 P; 355/3 BE; 355/3 DR

[58] Field of Search ..... 204/192 P, 192 S; 96/1.5; 428/539; 355/3 B; 430/94, 135

[56] References Cited

U.S. PATENT DOCUMENTS

| | | | |
|---|---|---|---|
| 3,819,370 | 6/1974 | Komiya et al. | 96/1.5 |
| 3,849,128 | 11/1974 | Ihara | 96/1.5 |
| 4,019,902 | 4/1977 | Leder et al. | 96/1.5 |
| 4,025,339 | 5/1977 | Kuehnle | 204/192 P |

OTHER PUBLICATIONS

Japanese Journal of Applied Physics vol. 9, #9, 9/70 Tawaka pp. 1070–1077.

Journal of Vacuum Science & Technology vol. 7, #2, 3/70, Lagnado rf Sputtered Cadmium Sulfide pp. 318–321.

*Primary Examiner*—Edward C. Kimlin

*Assistant Examiner*—John L. Goodrow

*Attorney, Agent, or Firm*—Silverman, Cass & Singer, Ltd.

[57] ABSTRACT

An endless belt or cylinder in which the base or substrate is a conductive member and there is a coating of a wholly inorganic, microcrystalline, high quantum yield, electronically anisotropic photoconductive material on the substrate. The coating is capable of being charged and thereafter exposed to radiant energy from an object such as a scene or pattern for selectively discharging the coating and providing a latent image of the object on the coating. The latent image can thereafter be developed by toner and transferred to a receptor such as a sheet of paper, cloth and the like.

The belt may be formed of highly flexible synthetic organic resin such as polyester or the like and in such case the coating will be deposited onto an intervening thin layer of an ohmic material.

The cylinder may be a relatively rigid one of metal.

The coating may be cadmium sulfide.

The method of making the cylinder or belt comprises forming the cylinder or belt and placing same in a sputtering apparatus and r.f. sputtering the coating onto the surface of the cylinder or belt.

13 Claims, 6 Drawing Figures

FIG. 1
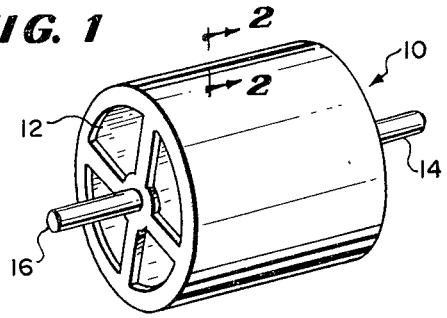
FIG. 2
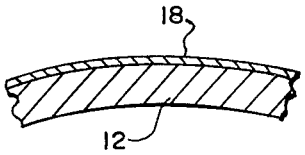
FIG. 3
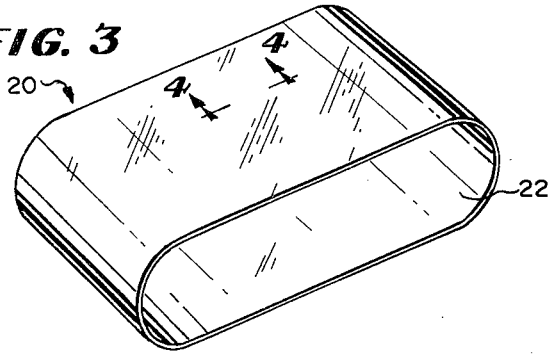
FIG. 4
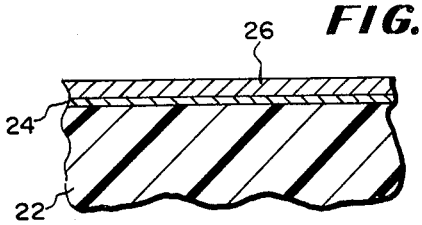
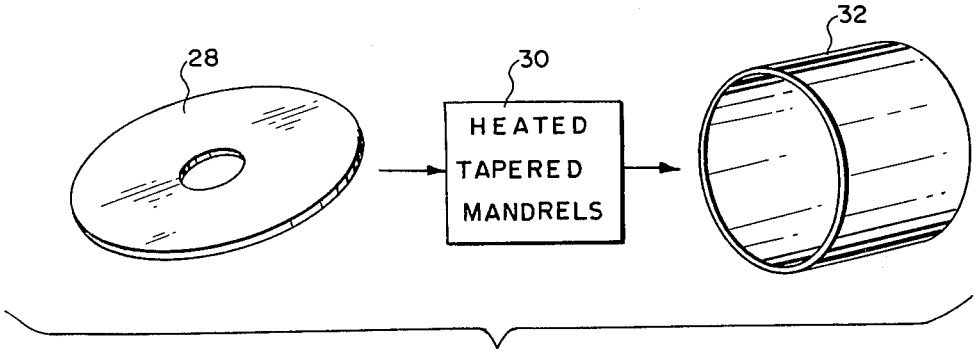
FIG. 5
FIG. 6
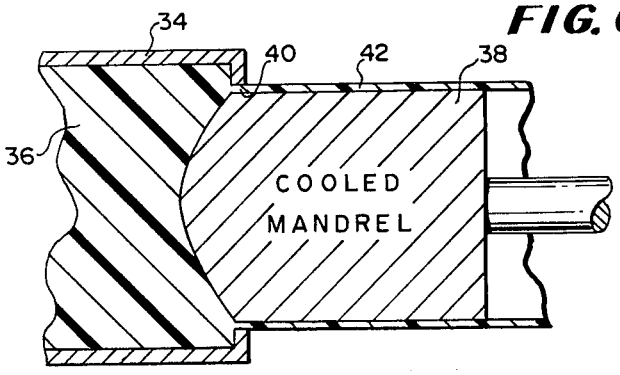

ENDLESS BELT OR CYLINDER FOR USE WITH ELECTROSTATIC IMAGING AND METHOD OF MAKING THE SAME

FIELD AND BACKGROUND OF THE INVENTION

The field of the invention is imaging by electrostatic techniques such as xerography or electrofax but includes printing as it is known in high speed presses. Specifically the invention is concerned with the provision of an endless belt or cylinder which has a conductive base or substrate and a coating of photoconductive material on the surface of the belt or cylinder. Hereafter the word "sleeve" will be used to designate a generic form including both belt and cylinder.

In the art of electrostatics there have been commercial structures which operate on the same basic principles to achieve images of objects. The basic concept consists of charging the surface of a photoconductive material which is capable of holding the charge in darkness, then exposing the surface to a radiant energy pattern such as a projected object, then developing the resulting latent image by means of toner. In xerography the toned image is transferred to a receptor while in electrofax the toned image is fixed as by fusing and the entire electrophotographic member becomes the article which emerges from the apparatus as a "copy" of the object.

The materials which have become commercially important in these fields are amorphous selenium, usually deposited as a layer of considerable thickness onto a rigid metal drum; zinc oxide particles in a matrix of organic material carried on a sheet of conductive paper; various photoconductive dyes on different kinds of substrate members; and even a slurry of cadmium sulfide in an organic matrix locked beneath a plastic sheet. The latter material is not chargeable per se since it is incapable of holding a charge but rather its plastic covering is chargeable and the cadmium sulfide slurry acts only in the photoconductive mode to assist in discharging increments of the plastic covering during exposure.

So far as known, available photoconductive materials are slow in response, have low resolution, require high voltages for charging and intense light for discharging, cannot be fully discharged and hence have objectionable background, and have other disadvantages. As such they are not suitable for use in any kind of high speed, high quality, economical imaging apparatus. For instance, high speed printing and multiple copy reproducing cannot be effected with known materials.

Recently a new material has been developed which is disclosed in U.S. Pat. No. 4,025,339 which not only overcomes all of the disadvantages of the prior photoconductive materials but has unusual benefits and attributes which never before existed. U.S. Pat. No. 4,025,339 is incorporated herein by reference and the disclosure thereof should be considered included herein.

The preferred form of the material of the invention comprises cadmium sulfide of ultrapure variety, with or without dopants, sputtered in an r.f. sputtering apparatus according to the teachings of the referenced patent.

In using the material in the combination comprising the invention herein several purposes are served. In duplicating or convenience copiers a relatively rigid drum can be utilized and the latent image formed on the drum, toned and the toner transferred to a web or sheet of paper or fabric or similar receptor after which the drum is cleaned, re-charged, re-exposed, etc., the cycle being repeated again and again for each copy.

In apparatus which requires that a flat planar member be available for the projection of an image thereon, either directly or through the member as for example in a machine which is intended to project large images onto the photoconductive material, the photoconductive material is deposited on a flexible cylinder that is shaped to provide an oval belt when it is installed in the machine. It may be transparent. The machine may be used by forming the toned image on the sleeve and transferring the image to another electrophotographic member which becomes the printing plate or transferring the image from the belt to a paper member which can thereafter be used as a copy or for other purposes.

For printing presses the sleeve or belt may be imaged and the image toned and fixed to provide a primary toned image on the photoconductive surface after which the sleeve or belt can be charged in light to charge only the surface of the fixed toner after which secondary toner can be picked up from a suitable fountain and transferred to a receptor.

The cylinders or belts can be sputtered directly in sputtering apparatus. The rigid cylinders are easily machined or cast. The belts or flexible sleeves can be formed in several ways including shaping flat members on heated mandrels or directly extruding the plastic substrates in plastic extruding machines onto mandrels which preserve their shape until cooled.

SUMMARY OF THE INVENTION

An endless sleeve in which the base or substrate includes a conductive member and there is a surface coating of a wholly inorganic, microcrystalline, high gain, electronically anisotropic photoconductive material sputtered onto the substrate. The sleeve may comprise a rigid metal cylinder or a seamless tubular belt or cylinder of synthetic resin having a thin film layer of an ohmic material bonded thereto and the photoconductive coating sputtered on top of the ohmic layer.

The sleeve of synthetic resin may be polyester, the ohmic layer indium-tin oxide having a thickness of about 200 Angstroms, the photoconductive layer ultrapure cadmium sulfide having a thickness between about 2000 Angstroms and 10,000 Angstroms. The polyester substrate may be of the order of a fraction of a millimeter in thickness.

The metal cylinder may be a fraction of an inch thick and formed of aluminum and the photoconductive layer of cadmium sulfide deposited thereon with a thickness somewhat greater than that utilized in the flexible sleeve because neither flexibility nor complete transparency is needed.

The basic tube of polyester may be formed either by reshaping flat members of polyester on heated mandrels or by extruding the tube directly from a plastic extruding machine.

BRIEF DESCRIPTION OF THE DRAWINGS

FIG. 1 is a perspective view of a relatively rigid metal drum having a coating of photoconductive material thereon, the assembly comprising an embodiment of the invention;

FIG. 2 is a fragmentary sectional view of the wall and surface of the drum of FIG. 1 taken along the line 2—2 and in the indicated direction;

FIG. 3 is a perspective view of an oval endless and seamless sleeve constructed in accordance with the invention;

FIG. 4 is an enlarged fragmentary sectional view of the wall and surface of the sleeve of FIG. 3 and taken along the line 4—4 thereof and in the indicated direction;

FIG. 5 is a diagrammatic view which is used to explain one method of making a synthetic resin tube for use in forming a sleeve according to the invention; and FIG. 6 is a diagrammatic sectional view through an extruding machine showing another method of making a synthetic resin tube for use in forming the sleeve of the invention.

DESCRIPTION OF THE PREFERRED EMBODIMENTS

As explained above the invention encompasses the formation of a sleeve which may be rigid or flexible and has a coating of a novel photoconductive material according to U.S. Pat. No. 4,025,339 sputtered onto the surface thereof. The advantages which obtain from this combination result from a marriage of the advantages of the photoconductive coating with a base member or substrate that provides benefits and functions beyond those which obtain through the use of these rigid or flexible sleeves in the prior art.

Among the advantages are the possibility of much higher speeds, the capability of producing higher resolution images, the accuracy which results. These attributes enable the sleeves to be used for commercial printing, for the making of printing plates, for the high speed reproduction of maps and objects with high accuracy, for the achievement of all of these ends with clean backgrounds never thought practical. Additional advantages achieved are the long life and durability of the sleeves, the economy occasioned by the simple form of the substrates upon which the deposits are made and the achievement of all of the advantages enumerated for the coating per se in the said U.S. Patent.

In FIG. 1 there is illustrated an aluminum cylinder or drum 10 having a relatively thick wall 12, say of the order of a fraction of an inch mounted on stub shafts 14 and 16. The cylinder base may be machined or cast and is intended for use in duplicating machines or convenience copiers. The shafts 14 and 16 enable the cylinder 10 to be mounted in a sputtering machine for applying the coating 18 which is sputtered in accordance with the teachings of the referenced patent. The cylinder 10 may have removable shafts or a hollow bore to enable its mounting in the sputtering machine and/or the duplicating machine. The thickness of the coating 18 may be somewhat less than a micron, but as thin as about 2500 Angstroms. It is sputtered directly onto the surface of the base since the base is conductive, this being necessary to effect charging but not being necessary to effect exposure.

In FIG. 3 there is illustrated a belt or sleeve 20 constructed according to the invention. The substrate 22 is a tube of synthetic resin such as polyester, polymer or the like which is chosen to be tough, durable and stable. The thickness will be a fraction of a millimeter making the substrate 22 highly flexible and also transparent as usual with resins of this type. Sources for such resins are Dupont, Celanese, Dow, American Cyanimid in the U.S. and Kalle in Europe. There is a thin film layer 24 of conductive material, called an ohmic layer, deposited upon the surface of the substrate 22 preferably by sputtering. The thickness of this layer is about 200 Angstroms or less and it can be formed of indium-tin oxide. It will be transparent. Upon this layer there is sputtered a coating 26 of photoconductive material which will be between 2000 Angstroms and 6000 Angstroms thick. This will provide transparency as may be needed in certain uses. Also the sleeve 20 will be flexible and easily handled and shipped.

In the sputtering of the sleeve 20 it may be held in a configuration of a cylinder or the oval belt form shown.

When constructed as described, the sleeve 20 of FIGS. 3 and 4 will be transparent to the extent that it will transmit from 70% to 85% of visible light.

Although belts may be made with seams that are no problem in imaging apparatus, it is preferred that the sleeves be seamless and formed as integral members. Thus there is no need to spend time or money in joining strips and no problem in trying to synchronize the imaging process to avoid a seam.

In FIG. 5 a process is indicated diagrammatically in which an annular disc of synthetic resin is progressively subjected to stretching and/or molding on a series of heated tapered mandrels ending with cylindrical to achieve the cylindrical substrate. The disc is shown at 28, the stretching or molding process is represented by the block 30 and the resulting cylinder or sleeve is shown at 32.

In FIG. 6 an apparatus is shown diagrammatically for extruding a tube. The housing 34 represents an extruding machine which has a charge of synthetic resin at 36. A mandrel 38 held in a suitable opening 40 defines a circle or oval through which a seamless tube or sleeve 42 is formed. The tube 42 is cooled after extrusion to maintain its shape after removal from the mandrel 38. This tube 42 is the same as the substrate 22 and can be processed after formation to provide the sleeve 20. It may be extruded in long lengths and cut to size or extruded and cut off as it is formed.

In the claims, "exposing" includes laser techniques where dots or other shapes are applied to the coating derived from stored or scanned data. "Development" includes reading the image, whether latent or otherwise by means of an electronic beam. "Ultrapure cadmium sulfide" does not exclude dopants.

Variations are capable of being made in the details of the invention without departing from the spirit or scope as defined in the appended claims.

What it is desired to secure by Letters Patent of the United States is:

1. An endless sleeve for electrostatic imaging and comprising a substrate of conductive material arranged for mounting in an imaging apparatus and having a photoconductive coating that has a thickness of the order of a micron and is at least about 2000 Angstroms thick, the coating being sputtered, microcrystalline, electrically anistropic, has a dark resistivity of at least $10^{12}$ and a ratio of light to dark resistivity of at least $10^4$, is a durable, wholly inorganic photoconductive material that is capable of being charged, exposed and developed.

2. The sleeve as claimed in claim 1 in which the substrate and coating are seamless.

3. The sleeve as claimed in claim 2 in which the substrate is a rigid metal cylinder.

4. The sleeve as claimed in claim 2 in which the substrate is a tubular member of synthetic resin having a layer of ohmic material a few hundred Angstroms thick bonded to the tubular member and sandwiched between that member and the photoconductive coating.

5. The sleeve as claimed in claim 2 in which the substrate is a tubular member of synthetic resin a fraction of a millimeter thick having a layer of ohmic material a few hundred Angstroms thick bonded to the tubular member and sandwiched between that member and the photoconductive coating, the sleeve being highly flexible.

6. The sleeve as claimed in claim 4 in which radiant energy is capable of passing through the wall of the sleeve, being transmitted to the extent of about 70% to 85% by the photoconductive coating.

7. The sleeve as claimed in claim 2 in which the photoconductive material is ultrapure cadmium sulfide.

8. The sleeve as claimed in claim 4 in which the photoconductive material is ultrapure cadmium sulfide.

9. The sleeve as claimed in claim 5 in which the photoconductive material is ultrapure cadmium sulfide.

10. The sleeve as claimed in claim 6 in which the photoconductive material is ultrapure cadmium sulfide.

11. A method of making a sleeve as claimed in claim 2 which comprises forming a tube from synthetic resin by means of heat, depositing a layer of ohmic material on the tube and sputtering a coating of the photoconductive material onto the ohmic layer.

12. The method as claimed in claim 11 in which the tube is formed by reshaping a flat member of said synthetic resin through the use of progressive tapered mandrels terminating in a cylindrical mandrel.

13. The method as claimed in claim 11 in which the tube is formed by extruding the same from a body of molten resin through a tube-defining opening and cooling the tube on a mandrel.

* * * * *